US010030642B1

(12) United States Patent
Myers

(10) Patent No.: US 10,030,642 B1
(45) Date of Patent: Jul. 24, 2018

(54) HIGH-VOLUME DIAPHRAGM WITH ANTI-ROLLING REINFORCEMENT

(71) Applicant: Douglas D. Myers, Jacksonville, FL (US)

(72) Inventor: Douglas D. Myers, Jacksonville, FL (US)

( * ) Notice: Subject to any disclaimer, the term of this patent is extended or adjusted under 35 U.S.C. 154(b) by 0 days.

(21) Appl. No.: 15/713,582

(22) Filed: Sep. 22, 2017

(51) Int. Cl.
*F04B 43/00* (2006.01)
*F04B 43/02* (2006.01)

(52) U.S. Cl.
CPC ..... *F04B 43/02* (2013.01); *F04B 43/0054* (2013.01)

(58) Field of Classification Search
CPC ..... F04B 43/0054
See application file for complete search history.

(56) References Cited

U.S. PATENT DOCUMENTS 3,911,796 A * 10/1975 Hull ..... B60T 17/08 92/101
5,349,896 A * 9/1994 Delaney, III ..... F04B 43/0054 92/103 F
5,490,659 A * 2/1996 Whiteside ..... E03D 3/06 251/331

* cited by examiner

*Primary Examiner* — F. Daniel Lopez
(74) *Attorney, Agent, or Firm* — Mark Young, P.A.

(57) ABSTRACT

A reinforced high-volume elastomeric pump diaphragm features several concentric circumferential reinforcing ribs (areas of increased thickness) integrally formed in the angled wall. Two ribs extend from the exterior to the interior. One rib, nearest the rim of the diaphragm, extends only to the exterior. This particular arrangement of ribs reduces rolling and appreciably improves performance by prolonging the useful life of the diaphragm.

10 Claims, 12 Drawing Sheets

HIGH-VOLUME DIAPHRAGM WITH ANTI-ROLLING REINFORCEMENT

FIELD OF THE INVENTION

This invention relates generally to diaphragm pumps, and, more particularly, to a large structurally enhanced elastomeric diaphragm.

BACKGROUND

Diaphragm pumps are useful for transferring large volumes of liquid (e.g., water) for agricultural, construction and marine industries among others. Such pumps may efficiently transfer even mud-laden water. Typically, such pumps comprise an elastomeric diaphragm driven by a pushrod or fluctuating pressure. High volume diaphragms, particularly diaphragms with relatively high walls, risk premature failure.

As used herein, a large or high-volume diaphragm has ac. In an exemplary embodiment, a large diaphragm according to principles of the invention has a wall height of at least three inches and a wall maximum diameter at the base of at least three times the wall height, and a wall minimum diameter at the cap of about at least twice the wall height.

Wear from abrasion and repeated strain (i.e., stretching) causes cracking along the walls of high-volume diaphragms. As a high-volume diaphragm is compressed, a portion of the wall may fold over against another portion of the wall, in overlapping fashion. This overlapping, which is known as "rolling," causes abrasion between abutting wall surfaces, while stresses concentrate at the fold line and cause stretching. Abrasion and stress compromise the wall's structural integrity, making it more susceptible to rolling, especially after repeated cycles. Eventually, the diaphragm fails, cracking or rupturing at the weakened wall.

For commercial viability, a diaphragm must perform, without failure, for a determined number of hours. The minimum number of hours is at least 600, more preferably at least 700, and ideally at least 1000 hours. Unreinforced high-volume diaphragms tend to fail after less than 700 hours of use and often less than 600 hours of use.

Others have tried reinforcing certain diaphragms with corrugations and longitudinal ribs. Such past efforts to reinforce diaphragms, while suitable for their own purpose, actually reduce the life of high-volume diaphragms. Corrugated high-volume diaphragms quickly experience rolling. Additionally, stresses concentrate along the edges of longitudinal ribs, leading to cracking.

What is needed is a reinforced high-volume diaphragm that resists rolling and endures use for at least 700 hours.

The invention is directed to overcoming one or more of the problems and solving one or more of the needs as set forth above.

SUMMARY OF THE INVENTION

To solve one or more of the problems set forth above, in an exemplary implementation of the invention, a reinforced hat-shaped high-volume elastomeric pump diaphragm is provided. The diaphragm features several concentric circumferential reinforcing ribs (areas of increased thickness) integrally formed in an angled wall. The wall has the shape of a hollow frustum, a thin-walled surface of revolution. A few of the ribs extend from the exterior to the interior. Importantly, at least one rib, nearest the rim extends only to the exterior. This arrangement of ribs reduces rolling of the diaphragm wall during compression. The rim is a flange that extends peripherally outwardly at the base of the wall. Opposite the rim, a thin-walled cover extends across the narrower end of the wall. The cover is generally disc-shaped. Mounting apertures are provided in both the rim and cover.

An exemplary integrally formed elastomeric pump diaphragm according to principles of the invention has a pumping volume in excess of 200 cubic inches. The integrally formed elastomeric pump diaphragm features a hat-shaped structure. The structure includes a wall having a thin-walled surface of revolution configuration, shaped as a hollow frustum. The wall defines a first end with a first diameter and a second end opposite the first end and having a second diameter. The second diameter is greater than the first diameter. The wall includes an exterior surface and an interior surface. A rim is formed at the second end. The rim is an annular (ring-shaped) flange extending outwardly from the wall. A cap is formed across the first end. A plurality of circumferential ribs are formed on the wall. Each rib is a solid projection. A first rib is closest to the rim and extends only from the exterior surface of the wall and not from the interior surface of the wall. A third rib is closest to the cap and extends from both the exterior and interior surfaces of the wall. The second rib is between the first rib and the third rib and extends from both the exterior and interior surfaces of the wall. The thickness of the wall is from about 0.25 to 0.0625 inches (preferably about 0.125 inches), and each rib of the plurality of circumferential ribs extends from the wall interior and/or exterior up to one times the wall thickness. Each rib of the plurality of circumferential ribs has a curvaceous (smoothly curved) cross section shape. Each of the cap and the rim has a thickness of about 4 times the thickness of the wall (e.g., of about 0.5 inches for a 0.125 inch wall thickness). The cap includes a plurality of mounting apertures. The rim and cap each include an upper surface and a lower surface, and a plurality of concentric ridges formed on each of the upper surface and the lower surface. The distance between the first end of the wall to the second end of the wall is at least three inches.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An exemplary integrally formed elastomeric pump diaphragm according to principles of the invention has a pumping volume in excess of 200 cubic inches. The integrally formed elastomeric pump diaphragm features a hat-shaped structure, which includes a wall having a thin-walled surface of revolution configuration, shaped as a hollow frustum. The wall defines a first open end with a first diameter and a second open end opposite the first end and having a second diameter. The second diameter is greater than the first diameter. The wall includes an exterior surface and an interior surface.

The wall includes structural features at each end. A rim is formed at the second end of the wall. The rim is an annular (ring-shaped) flange extending outwardly from the wall. A cap is formed across the first end of the wall. The cap includes a plurality of mounting apertures.

A plurality of circumferential ribs are formed on the wall. Each rib is a solid projection. A first rib is closest to the rim and extends only from the exterior surface of the wall and not from the interior surface of the wall. A third rib is closest to the cap and extends from both the exterior and interior surfaces of the wall. The second rib is between the first rib and the third rib and extends from both the exterior and interior surfaces of the wall.

Relative dimensions defines certain structural features. The thickness of the wall is from about 0.25 to 0.0625 inches (preferably about 0.125 inches), and each rib of the plurality of circumferential ribs extends from the wall interior and/or exterior up to one times the wall thickness. Each rib of the plurality of circumferential ribs has a curvaceous (smoothly curved) cross section shape. Each of the cap and the rim has a thickness of about 4 times the thickness of the wall (e.g., of about 0.5 inches for a 0.125 inch wall thickness). The distance between the first end of the wall to the second end of the wall (i.e., the wall height) is at least three inches.

The rim and cap each include an upper surface and a lower surface, and a plurality of concentric ridges formed on each of the upper surface and the lower surface.

Figure 1:
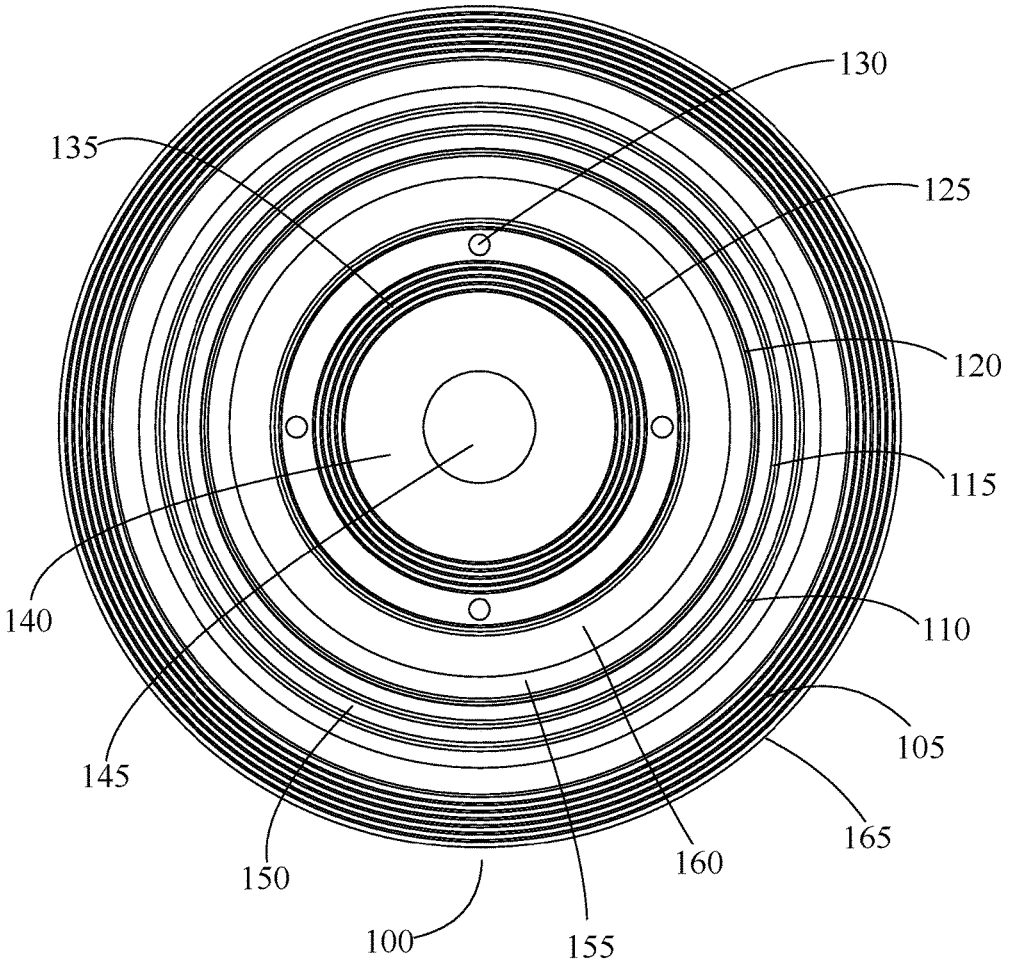
FIG. 1 is a plan view of an exemplary reinforced high-volume diaphragm according to principles of the invention.
Figure 2:
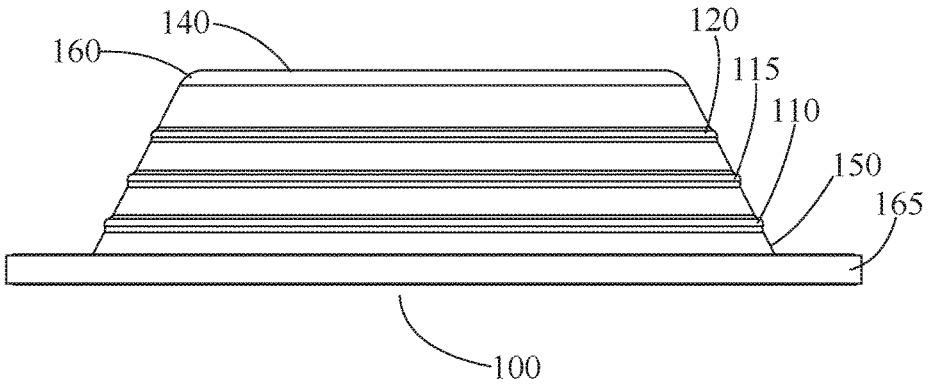
FIG. 2 is a side view of an exemplary reinforced high-volume diaphragm according to principles of the invention.
Figure 3:
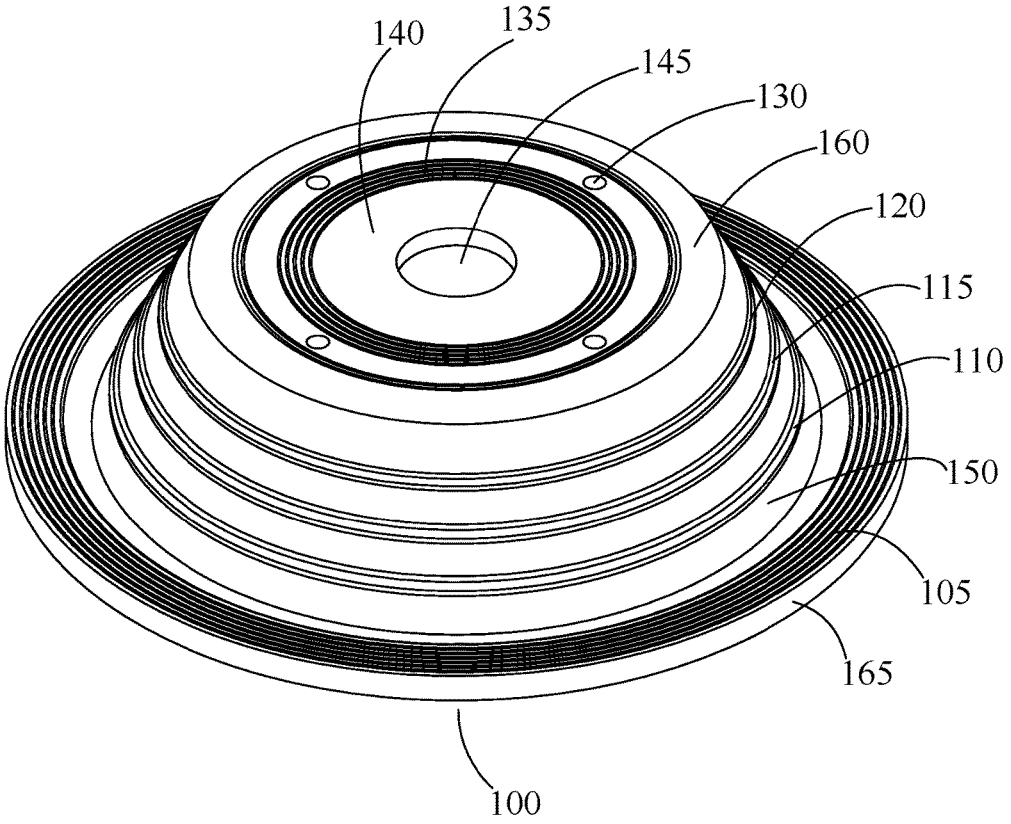
FIG. 3 is a first perspective view of an exemplary reinforced high-volume diaphragm according to principles of the invention.

Referring now to FIGS. 1 through 3, various views of the exterior of an exemplary reinforced high-volume diaphragm 100 according to principles of the invention are provided. The high-volume diaphragm 100 is generally hat shaped, with a rim 165 at the nominal bottom, a cover (aka cap) 140 at the nominal top, and a wall 150 extending from the rim 165 to the cover 140. A filleted edge 160 provides a transition from the cap 140 to the top portion 155 of the wall 150. The wall 150 has the shape of a hollow frustum, a thin-walled surface of revolution. The angle of the wall 150 is a draft angle for molding. The diaphragm 100 features several concentric circumferential reinforcing ribs 110, 115, 120 integrally formed in the angled wall 150. As the diaphragm may be oriented other than as depicted, the top of the diaphragm or component thereof as shown in the drawings is referred to as the nominal top, and, likewise, the bottom of the diaphragm or component thereof as shown in the drawings is referred to as the nominal bottom.

The ribs 110, 115, 120 are areas of increased thickness with curved surfaces and smooth transitions from the wall 150. In an exemplary embodiment, the ribs 110, 115, 120 may have a generally circular, semicircular, elliptical or a sinusoidal cross section shape. These smoothly curved shapes are collectively referred to herein as curvaceous shapes.

Figure 4:
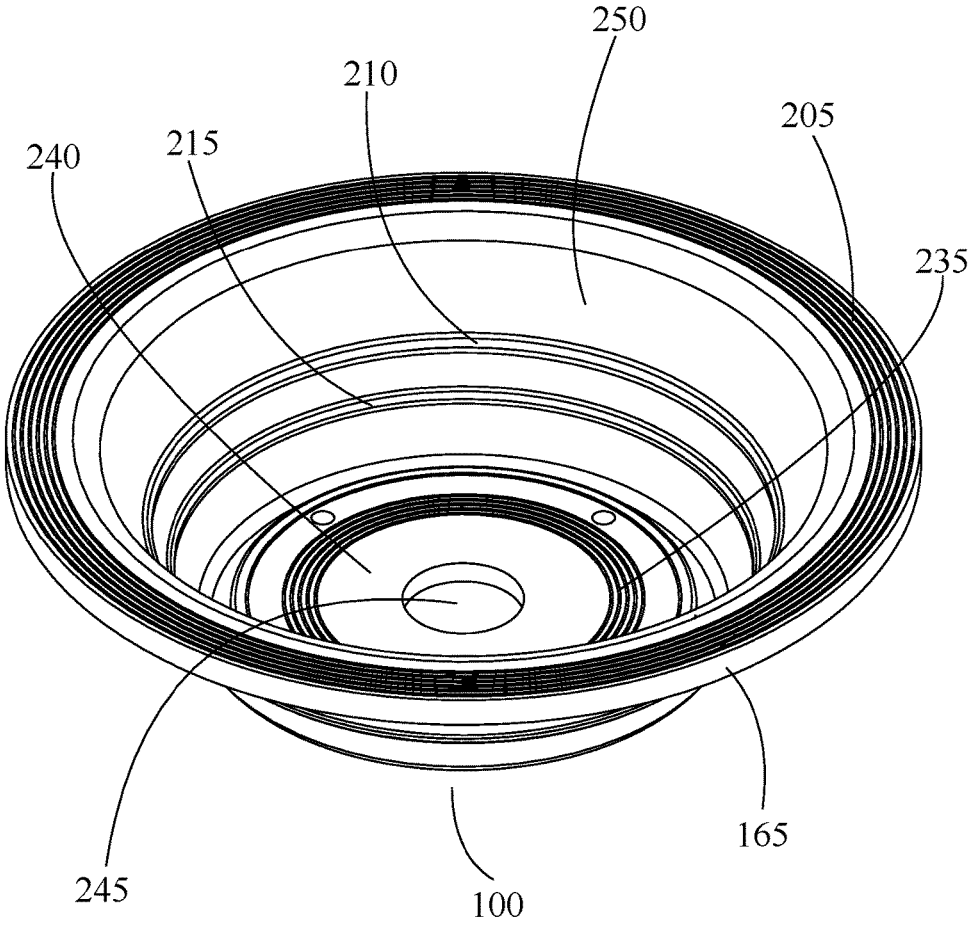
FIG. 4 is a second perspective view of an exemplary reinforced high-volume diaphragm according to principles of the invention.
Figure 5:
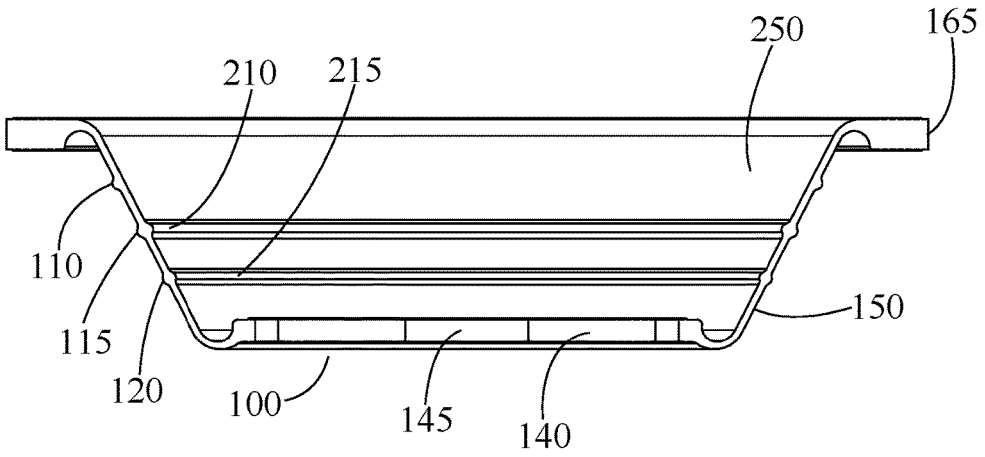
FIG. 5 is a side view of a section of an exemplary reinforced high-volume diaphragm according to principles of the invention.
Figure 6:
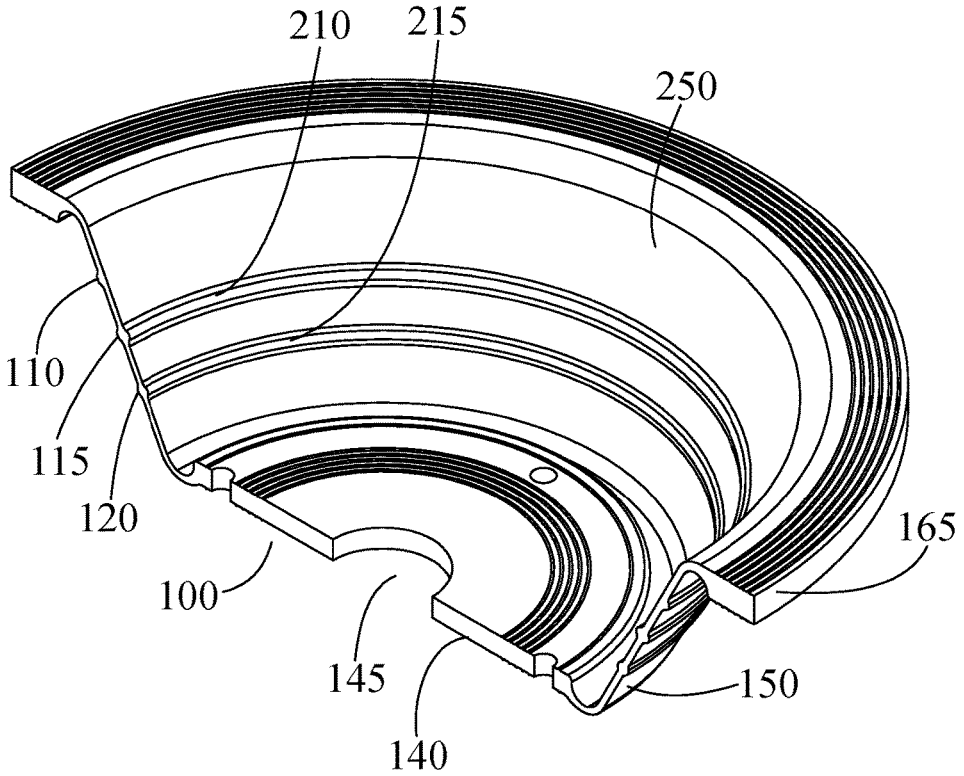
FIG. 6 is a perspective view of a section of an exemplary reinforced high-volume diaphragm according to principles of the invention.

A few of the ribs 115, 120 extend from the exterior to the interior, i.e., extend from the wall exterior 150 and the wall interior 250. The exterior of the diaphragm 100 is illustrated in FIGS. 1 through 3. The interior is shown in FIGS. 4 through 6. In use, compression of the diaphragm 100 urges the cap 140 towards the rim 165, forcing liquid out of the interior space. The interior portions 210, 215 of the ribs are shown in FIGS. 5 and 6. One rib 110, nearest the rim 165, extends only to the exterior, i.e., from the wall exterior 150. This absence of any extension from the wall interior 250 for the rib 110 nearest the rim is an important aspect of the invention. The distance between adjacent ribs is less than one inch, preferably less than 0.75 inches, and more preferably about 0.5 inches. The distance between the rib 110 nearest the rim 165 is less than one inch, preferably less than 0.75 inches, and more preferably about 0.5 inches. This arrangement of ribs 110, 115, 120, 210, 215 reduces rolling of the diaphragm wall 150 during compression.

In the exemplary embodiment, the ribs 110, 115, 120, 210, 215 do not protrude from the wall surfaces by more than the thickness of the wall. The thickness of the wall 150 of the exemplary diaphragm 100 is about 0.125 inches. The ribs 110, 115, 120, 210, 215 protrude from the exterior and/or interior surface of the wall 150 by about 0.1 to 1.0 times the thickness of the wall, preferably about 0.25 to 0.75 times the thickness of the wall 150.

The rim 165 is a flange that extends peripherally outwardly (e.g., about 1 inch outwardly) at the base of the wall 150. In the exemplary embodiment, the rim 165 has a thickness of about 0.5 inches, about 4 times the wall thickness. A plurality of concentric shallow ridges 105, 205 are formed on the top surface and bottom surface of the rim 165. The ridges 105, 205 provide seals and grippable surfaces when the rim 165 is clamped for installation.

Opposite the rim, a thin-walled cover (cap 140) extends across the narrower end of the wall 150, 250. The interior surface 250 of the wall 150 is visible in FIGS. 4, 5 and 6. In the exemplary embodiment, the cap 140 has a thickness of about 0.5 inches, about 4 times the wall thickness. The cap 140 is generally disc-shaped. Mounting apertures 130, 145 are provided in the cap 140. A plurality of concentric shallow ridges 135, 235 are formed on the top surface and bottom surface of the cap 140, 240. The ridges 135 provide seals and grippable surfaces when the cap 140 is clamped for installation.

Figure 7:
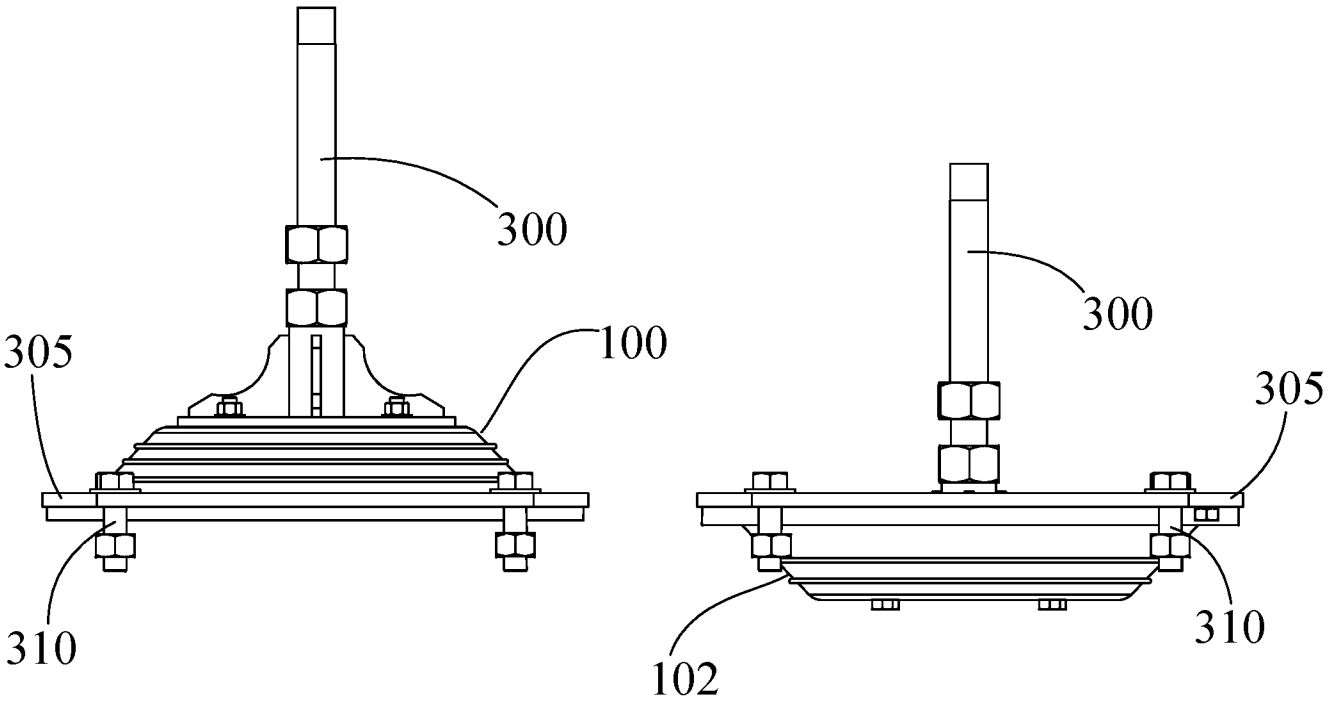
FIG. 7 is a schematic of portions of a two diaphragm pumping mechanism comprising a pair of exemplary reinforced high-volume diaphragms according to principles of the invention.

FIG. 7 is a schematic of portions of a two diaphragm pumping mechanism 300, 302 comprising a pair of exemplary reinforced high-volume diaphragms 100, 102 according to principles of the invention. As one diaphragm 102 is compressed, the other 100 is decompressed, and vice versa. The pumping mechanisms 300, 302 operate continuously during normal use, with the rods that impart compression to the diaphragms being coupled to a crank.

This invention is not limited to use with any particular pumping mechanism. The pumping mechanism conceptually illustrated in FIG. 7 is provided as a non-limiting contextual example.

Figure 8:
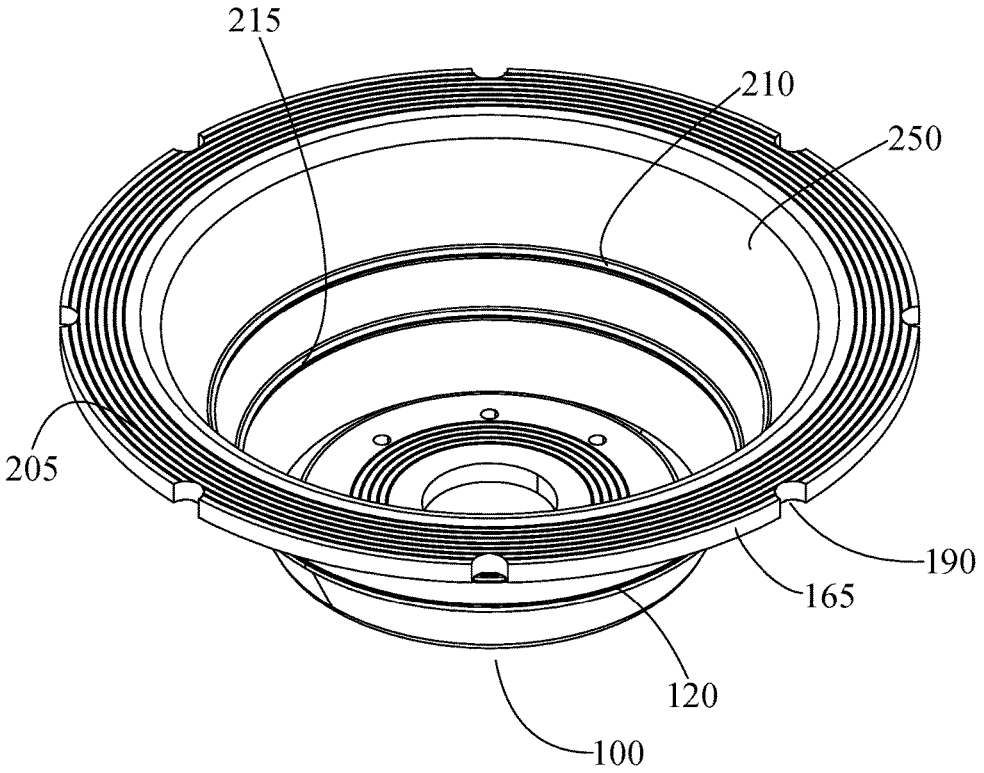
FIG. 8 is a perspective view of another exemplary reinforced high-volume diaphragm according to principles of the invention.
Figure 9:
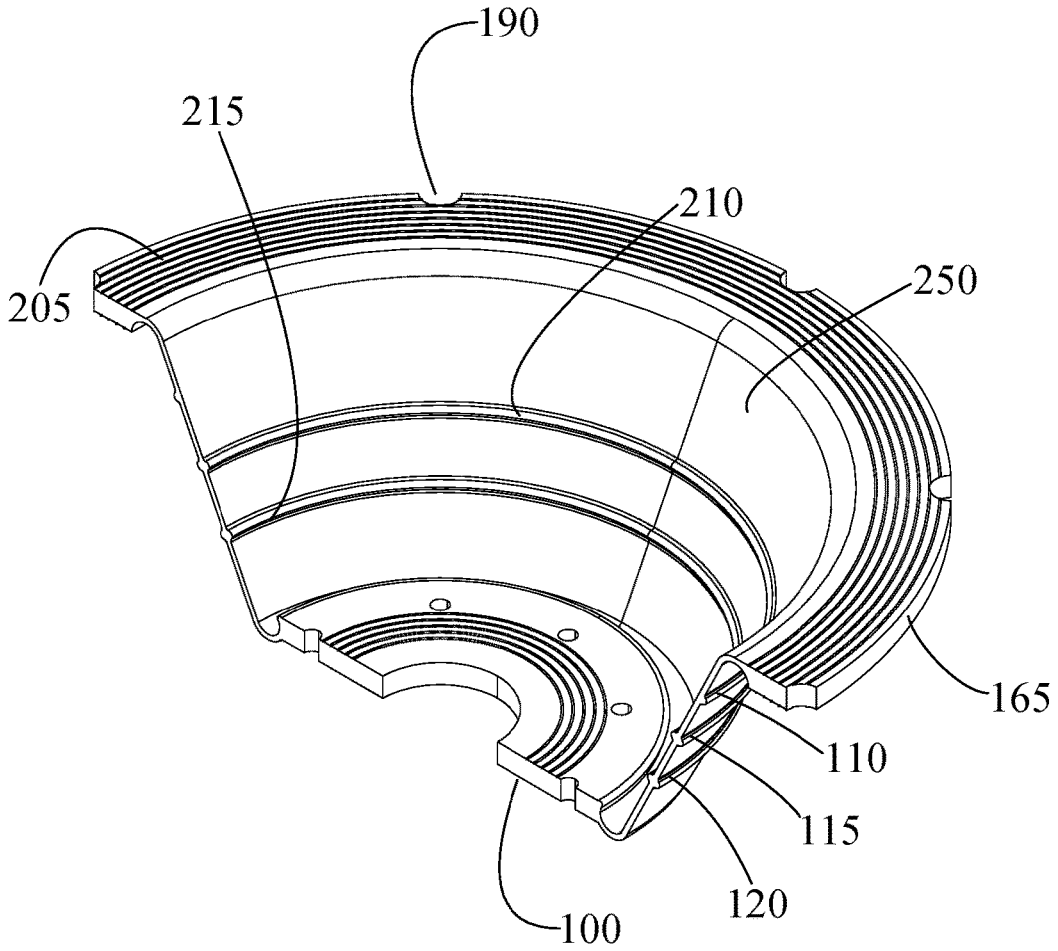
FIG. 9 is a perspective view of a section of an exemplary reinforced high-volume diaphragm according to principles of the invention.

In another embodiment as shown in FIGS. 8 and 9, a large diameter diaphragm according to principles of the invention further includes a rim 165 with a plurality of alignment cutouts 190. Alignment cutouts 190, also known as peripheral alignment cutouts, are semicircular or similarly shaped concavities formed (e.g., cut or molded) in the free edge of the annular flange comprising the rim 165. When installed, the rim 165 is sandwiched between a mounting surface and a retaining ring 305 (FIG. 7). Shanks of bolts 310 extend through the retaining ring 305 into the mounting surface. The alignment cutouts 190 align with the shank of each bolt 310, such that the shank extends through the concavity. The concavity has a diameter that is about the same or only slightly larger than the diameter of the shank. But for the aligned concavity the shank of the bolt would hit the rim 165. There may be more alignment cutouts 190 than bolts 310, or as many alignment cutouts 190 as bolts 310. This configuration ensures that the diaphragm 100 is centered when mounted. Such centering evenly distributes stresses and prolongs the life of the diaphragm.

Figure 10:
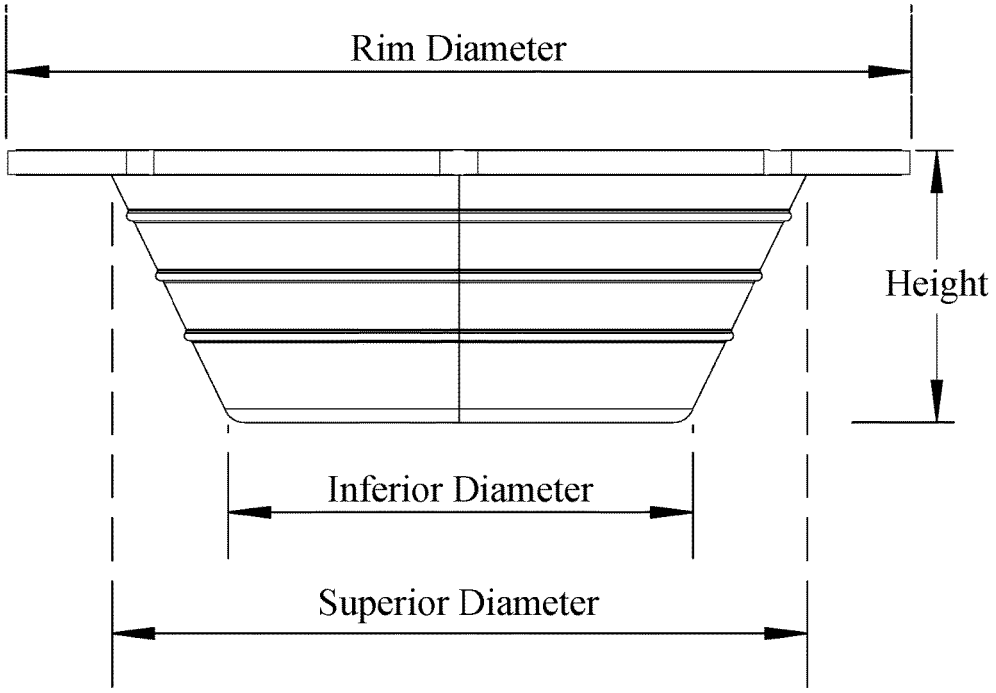
FIG. 10 is a side view of an exemplary reinforced high-volume diaphragm according to principles of the invention with labeled dimensions.
Figure 11:
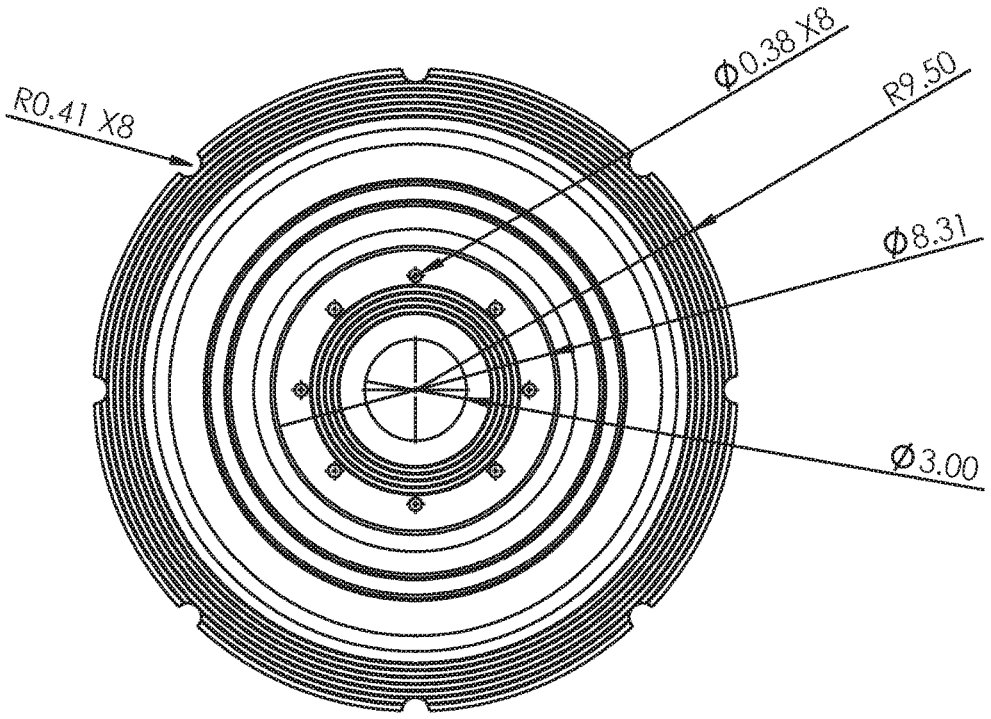
FIG. 11 provides a dimensioned plan view of an exemplary reinforced high-volume diaphragm according to principles of the invention.
Figure 12:
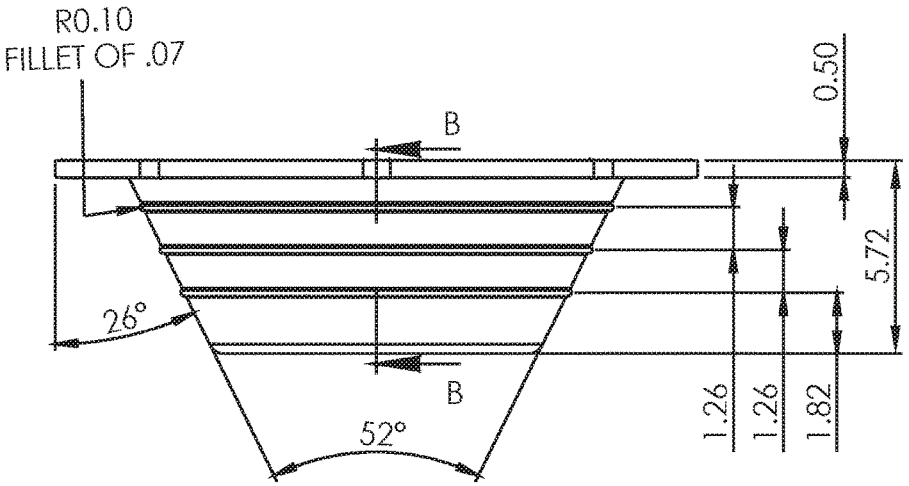
FIG. 12 provides a dimensioned side view of an exemplary reinforced high-volume diaphragm according to principles of the invention.
Figure 13:
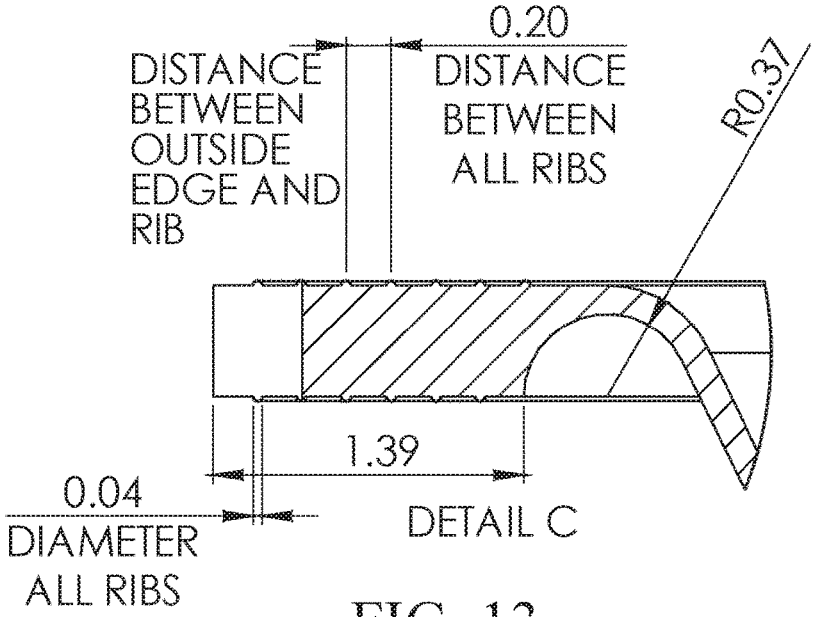
FIG. 13 provides a detail view of portion C from FIG. 14.
Figure 14:
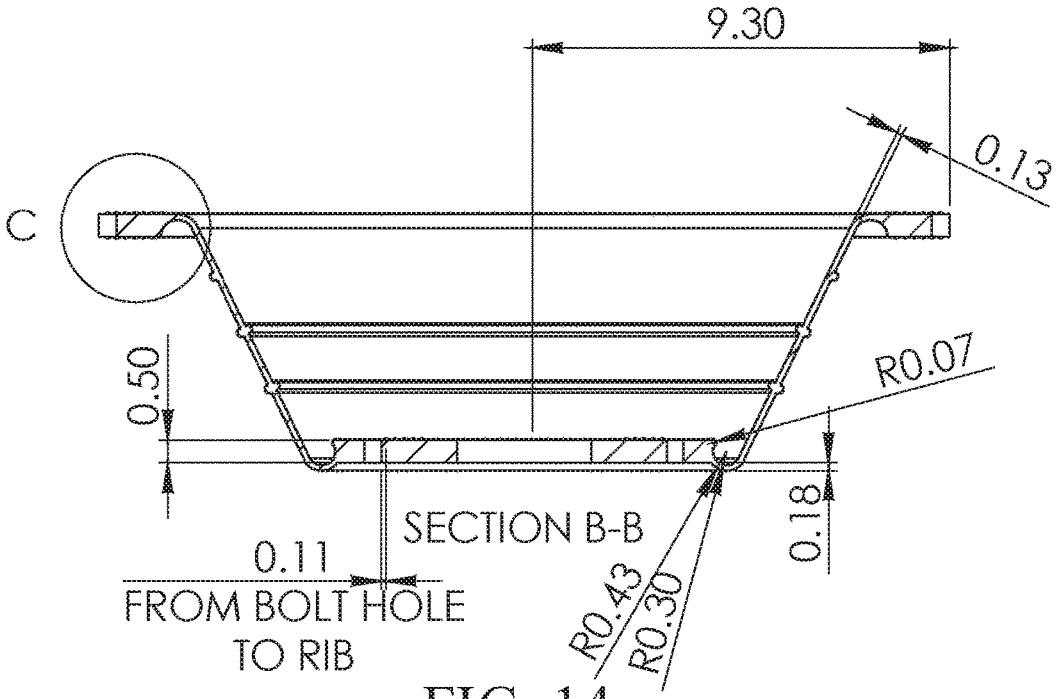
FIG. 14 provides a dimensioned side view of section B-B from FIG. 12.

With reference to FIG. 10, nonlimiting examples of diaphragms according to principles of the invention may have a superior diameter of 12 to 16 inches, a rim diameter of 13 to 20 inches, an inferior diameter of 5 to 10 inches, and a height of at least 3 inches. Such a large diaphragm, if not reinforced, is particularly vulnerable to rolling during compression, and consequential premature structural failure. With reinforcing ribs configured and arranged as described above, useful life of the diaphragm is substantially improved.

In a non-limiting exemplary embodiment, a diaphragm 100 according to principles of the invention is comprised of a thermoplastic elastomer (TPE), and more particularly a thermoplastic vulcanizate (TPV), and even more particularly Exxon Mobile Corporation's Santoprene™ TPV. Santoprene™ TPV is a dynamically vulcanized alloy comprised of cured EPDM rubber particles encapsulated in a polypropylene (PP) matrix. Santoprene™ TPV has been found effective for such a diaphragm 100, providing flexibility (elasticity and resilience) and acceptable structural integrity for long-term performance. Additionally, in a non-limiting exemplary embodiment, the diaphragm 100 is integrally formed via injection molding.

Dimensioned views of an exemplary diaphragm according to principles of the invention are provided in FIGS. 11-14. As used in FIGS. 11-14, R denotes a radius, Φ denotes a diameter and numerical values are dimensions in inches. The specified dimensions are non-limiting examples.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. An integrally formed elastomeric pump diaphragm having a pumping volume in excess of 200 cubic inches, the integrally formed elastomeric pump diaphragm comprising a hat-shaped structure, the hat-shaped structure comprising:

a wall comprising a thin-walled surface of revolution shaped as a hollow frustum, the wall defining a first end with a first diameter and a second end opposite the first end and having a second diameter, the second diameter being greater than the first diameter, the wall including an exterior surface and an interior surface; and an annular flange extending outwardly from the second end; and a cap formed across the first end; and a plurality of circumferential ribs formed on the wall, the plurality of circumferential ribs including a first rib, a second rib and a third rib, the first rib being closest to the annular flange, the first rib extending only from the exterior surface of the wall and not from the interior surface of the wall, and the third rib being closest to the cap, the third rib extending from both the exterior and interior surfaces of the wall, and the second rib being between the first rib and the third rib and extending from both the exterior and interior surfaces of the wall.

2. The integrally formed elastomeric pump diaphragm of claim 1, wherein a thickness of the wall is from 0.25 to 0.0625 inches, and each rib of the plurality of circumferential ribs extends from the wall up to one times the wall thickness.

3. The integrally formed elastomeric pump diaphragm of claim 1, wherein a thickness of the wall is about 0.125 inches, and each rib of the plurality of circumferential ribs extends from the wall up to one times the wall thickness.

4. The integrally formed elastomeric pump diaphragm of claim 1, wherein each rib of the plurality of circumferential ribs has a curvaceous cross section shape.

5. The integrally formed elastomeric pump diaphragm of claim 2, wherein each of the cap and the annular flange has a thickness of about 4 times the thickness of the wall.

6. The integrally formed elastomeric pump diaphragm of claim 1, wherein each of the cap and the annular flange has a thickness of about 0.5 inches.

7. The integrally formed elastomeric pump diaphragm of claim 1, the cap including a plurality of mounting apertures.

8. The integrally formed elastomeric pump diaphragm of claim 1, the annular flange including an upper surface and a lower surface, a plurality of concentric annular flange ridges formed on each of the upper surface of the annular flange and the lower surface of the annular flange, and a plurality of peripheral alignment cutouts.

9. The integrally formed elastomeric pump diaphragm of claim 1, the cap including an upper surface and a lower surface, and a plurality of concentric cap ridges formed on each of the upper surface of the cap and the lower surface of the cap.

10. The integrally formed elastomeric pump diaphragm of claim 1, a distance between the first end of the wall to the second end of the wall being at least three inches.

* * * * *